United States Patent [19]

Krause

[11] 4,004,259

[45] Jan. 18, 1977

[54] TEMPERATURE RESPONSIVE ELECTRIC SWITCH

[75] Inventor: Ward Barry Krause, Alexander, N.C.

[73] Assignee: Square D Company, Park Ridge, Ill.

[22] Filed: June 25, 1975

[21] Appl. No.: 590,359

[52] U.S. Cl. ..... 335/146; 335/208; 335/284

[51] Int. Cl.[2] ..... H01H 61/00; H01F 13/00

[58] Field of Search ..... 335/208, 146, 217, 284; 317/123

[56] References Cited

UNITED STATES PATENTS

| | | | |
|---|---|---|---|
| 2,144,546 | 1/1939 | Reese et al. | 335/217 |
| 3,303,398 | 2/1967 | Barta et al. | 335/284 X |
| 3,428,867 | 2/1969 | Becker | 335/284 X |
| 3,760,310 | 9/1973 | Carson | 335/146 |

*Primary Examiner*—George Harris
*Attorney, Agent, or Firm*—William H. Schmeling; Harold J. Rathbun

[57] ABSTRACT

A thermomagnetic switch is mountable on a chamber wall to extend into a liquid filled chamber. A reed switch in the switch is controlled by the strength of a magnetic field produced by a cylindrical magnet surrounding the reed switch. The magnetic flux passing through the reed switch is varied by a ferromagnetic cylindrical element having a magnetic permeability varying with temperature that shunts magnetic flux at a level varying with temperature. A ferrous slug or shaft adjacent to the reed switch is movable to shunt a selectable portion of the magnetic flux and permit a fine temperature adjustment. A method of adjusting the operating temperature of switch reduces the magnetic strength of the magnet in the switch in small increments while the switch is exposed to a selected temperature until the switch operates to establish its operating temperature.

11 Claims, 5 Drawing Figures

TEMPERATURE RESPONSIVE ELECTRIC SWITCH

This invention relates to electric switches, particularly to electrical switches that are temperature responsive and magnetically operated and to a method for adjusting magnetic switches.

Temperature responsive switches using temperature responsive magnetic shunting material and a reed switch controlled by a magnetic field are known and frequently used for controlling the temperature of a liquid by switching a heating unit or a similar device on and off. These switches vary in type and quality depending upon the accuracy and severity of the application in which the switch is used. A switch according to this invention is an improvement over such prior art switches and over the switch disclosed in a co-pending patent application, which issued as U.S. Pat. No. 3,890,586 on June 17, 1975.

With this invention a switch is provided having simple construction, and an easy means for making the final temperature adjustment, and a method is provided for adjusting magnetic switches. The objects and advantages of the invention will be apparent from the following description.

Figure 2:
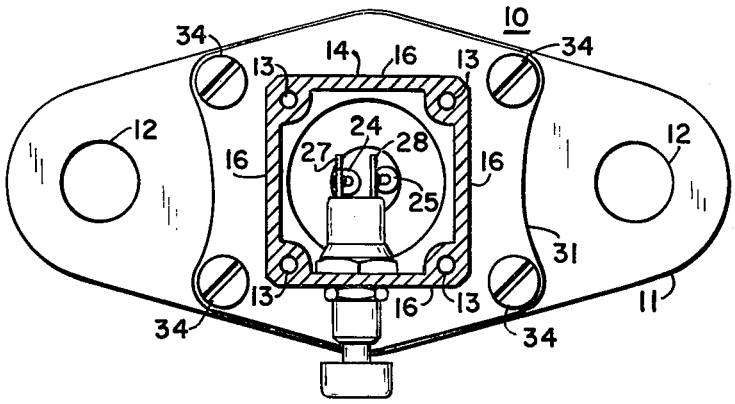
FIG. 2 is a cross-sectional view taken along line 2—2 of FIG. 1.
Figure 1:
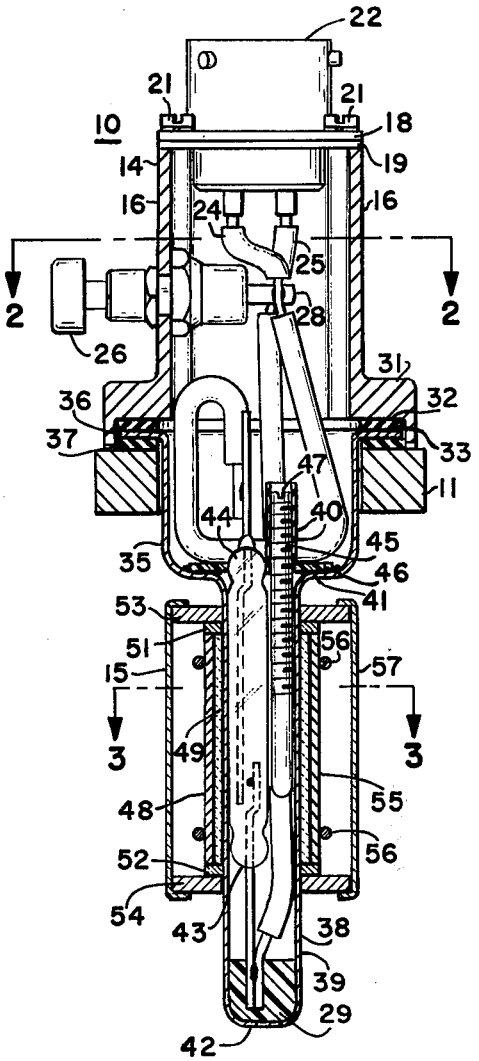
FIG. 1 is a partial cross-sectional view of a switch according to this invention.
Figure 3:
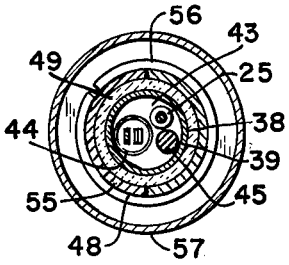
FIG. 3 is a cross-sectional view of FIG. 1 taken along lines 3—3 of FIG. 1.

Referring to FIGS. 1 and 2, a temperature control switch 10 according to this invention is mounted on a mounting flange or plate 11 having bolt openings 12 for receiving bolts (not shown) to attach the switch to the wall of a chamber containing a liquid in any manner known in the art. Switch 10 comprises an upper housing 14 and a lower housing 15 which includes the portion of the switch that would be submerged in the fluid that is to be temperature controlled. Upper housing 14 comprises walls 16 enclosing a chamber with an open top covered by a cover 18 and a sealing gasket 19 both of which are secured to the housing by screws 21 screwed into taps 13 formed in the housing at the intersections of walls 16. Cover 18 comprises an electrical connector 22 of any suitable type known in the art for connecting switch 10 to an electrical circuit to be controlled by the switch.

The chamber formed by walls 16 encloses and contains electrical insulated conductors, or wires, 24 and 25 connected to electrical connector 22 in any manner known in the art and a push button test switch 26 of any type known in the art having two terminals 27 and 28 connected to conductors 24 and 25, respectively, by soldering or other known means. Switch 26 provides a means for closing the circuit across conductors 24 and 25 to test the circuit connected to be controlled by electrical switch 10. Electrical conductors 24 and 25 pass through upper housing 14 into lower housing 15.

The upper and lower housing are connected to each other to form a fluid tight seal at an annular flange 31 formed by a lower opening of upper housing 14 which also forms an annular shoulder 32. An annular gasket 33 is seated in shoulder 32.

Lower housing 15 is formed by a cylindrical wall 35 having an open end with an annular flange 36 that seats against gasket 33 to form a seal between the upper and lower housings. An annular gasket 37 is seated on the other side of flange 36 to form a seal between plate 11 and flange 36 to enable a fluid tight connection to be made when switch 10 is mounted in a hole in a chamber wall created for insertion of the switch. The upper housing, lower housing and plate are connected to each other and the gaskets compressed by screws 34 inserted into taps (not shown) in plate 11.

Lower housing 15 also comprises a lower cylindrical extention 38 having a cylindrical extension wall 39 creating a cylindrical diameter substantially less than the cylindrical diameter of cylindrical wall 35 at the upper portion of lower housing 15. Cylindrical extension 38 is connected to cylindrical wall 35 by a shoulder 41 and forms a single chamber or cavity open to the cavity or chamber formed by cylindrical wall 35. The other, or lower, end of cylindrical wall 39 is closed by an end wall 42.

A temperature responsive switching assembly 43 has a magnetically responsive switch element such as a reed switch 44 of any type known in the art movable to a closed position in response to the level of magnetic flux passing through it; a ferromagnetic adjustable slug, shaft or element 45 having a slotted head 47 and a screw thread outer surface, a tapped piece 46 which receives the threaded end of slug 45, an insulating sleeve 40 surrounding the upper portion of the slug 45 and a plastic insulating material support base 29 in the bottom of cylindrical extension 38 that supports one end of reed switch 44. Electrical conductors 24 and 25 pass through upper housing 14 and into lower housing 15 with conductor 24 connected to one end of reed switch 44 and conductor 25 connected at support base 29 to the other end of reed switch 44.

A magnetic control assembly 48 is circumferentially mounted around cylindrical wall 39 of extension 38 and comprises a cylindrical magnet 49, an abutting upper pole piece 51, an abutting lower pole piece 52, an upper nonferrous spacer 53, a lower nonferrous spacer 54, a cylindrical compensating element 55 made of a ferromagnetic material that has a magnetic permeability that varies as a function of temperature, spring clips 56 connected to hold the compensating element 55 in place, and a perforated shield 57 for protecting the magnetic assembly from the influence of ferrous materials or external magnetic fields.

In the manufacture of switch 10 the magnetic material for magnet 49 is selected and its magnetic level adjusted to produce a magnetic flux at a level suitable for the selected switch application. The ferromagnetic material for compensating element 55 is selected to provide the desired permeability variation, preferably within the linear range, over the expected temperture range. The cross-sectional area of the compensating element 55 is determined by its magnetic permeability characteristics and the characteristics of the reed switch 44 selected so that the flux through the reed switch 44 will operate the reed switch 44 at the desired operating temperature differential at approximately the desired temperature. The differential is the difference between the temperature at which the reed switch 44 will open and the temperature at which it will close which is determined by the difference in magnetic flux required to close the reed switch 44 as opposed to that which will permit the reed switch 44 to open after it is closed. The level of magnetic flux through the reed switch 44 is therefore directly related to the temperature of the fluid and the compensating element 55. The permeability of the compensating element 55 increases and shunts the magnetic flux around the reed switch 44 at a level varying as a function of its temperature and to a greater degree as the temperature of the compensating element 55 decreases.

The selection of the characteristics of the reed switch 44, the strength of the magnet 49, the type of compensating element 55, and the cross-sectional area of the compensating element 55 all contribute to selecting the temperature and differential at which the reed switch 44 will operate. However, the differential is essentially established by the reed switch 44 characteristics and compensating element cross-sectional area and is largely determined when the switch is designed. The operating temperature is not as accurately determinable so that additional adjustment means are provided to select the actual operating temperature of the switch. This is accomplished by bypassing a selected portion of the flux available around the reed switch 44 through the slug 45. The slug 45 is rotated and the screw effect of its outer surface in the tapped piece 46 positions it to a greater or lesser degree within the magnetic flux field that is affecting reed switch 44. As slug 45 is moved further into extension 38 it absorbs more of the magnetic flux that would pass through reed switch 44 and thereby raises the operating temperature of the switch. This adjustment essentially selects the operating temperature and has no significant effect on the temperature differential operation.

In manufacturing and designing a magnetically controlled switch, it is usually necessary to accurately control the strength of magnet 49. The magnet may be selected to have a particular strength, but practically it is desirable to adjust the strength of the magnet to create an accurate switch. The preferable way is to adjust the magnet strength after the reed switch 44, magnet, and compensating element are finally assembled.

In the manufacture of a switch according to this invention, the particular alloys and the cross-sectional area of the compensating element, and the desired reed switch 44 characteristics are selected to produce the desired temperature differential operation. The operating temperature of the switch is then selected by adjusting the strength of the magnet and finally adjusted by positioning slug 45. According to this invention, a means and method for calibrating or adjusting the switch is provided to establish the operating temperature of the switch by accurately adjusting the strength of the magnet. This method comprises using an electromagnetic coil to saturate the magnet in the switch and to "knock down" the strength of the magnet in small incremental steps until the desired temperature of operation is attained.

Figure 4:
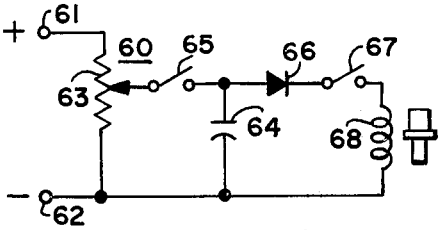
FIG. 4 is a schematic of an electrical circuit usable for adjusting the switch shown in FIG. 1.

The method includes first placing the switch in a unidirectional magnetic field of sufficient strength to saturate its magnet in one direction. Referring to FIG. 4, a circuit 60 comprises a direct current source having a positive terminal 61 and a negative terminal 62 connected across a potentiometer 63, and a capacitor or capacitor bank, 64. The capacitor is connected to be charged by the direct current source through a switch 65 and the tap of potentiometer 63. Circuit 60 also comprises a circuit for discharging capacitor 64 through a diode 66, a switch 67 and a coil 68 that is of a type large enough to encompass switch 10 and enclose it in the magnetic field created by coil 68 and to produce a magnetic field sufficiently strong to saturate the magnet in switch 10.

To saturate the magnet, after switch 10 is assembled, it is placed within coil 68 so as to be subjected to the magnetic field produced. Switch 65 is closed for the time necessary to charge capacitor 64 to a level selected by the direct current source level and the setting of potentiometer 63. After capacitor 64 is charged to the selected level, switch 65 is opened and switch 67 is closed. The closing of switch 67 discharges capacitor 64 through coil 68 producing a magnetic flux sufficient to saturate the magnet. Diode 66 prevents reverse current that would result from the expected oscillation created by the capacitance-inductance circuit.

Figure 5:
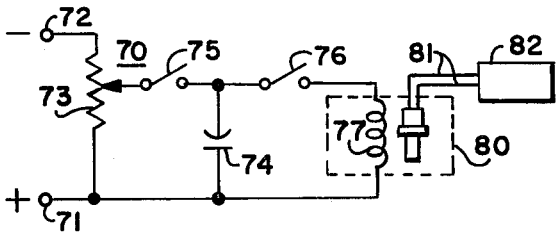
FIG. 5 is a schematic of an electrical circuit also usable for adjusting the switch shown in FIG. 1.

Upon the saturation of the magnet in switch 10, the reed switch 44 is in a closed condition. To adjust the operating temperature of the switch an incremental demagnetizing circuit 70 is used. Referring to FIG. 5, circuit 70 comprises a direct current source having a positive terminal 71 and a negative terminal 72 connected across a potentiometer 73 to charge a capacitor, or capacitor bank 74, through potentiometer 73 by closing a switch 75. A circuit for discharging capacitor 74 has a switch 76 and a coil 77. Coil 77 is of a type that may be submerged in a liquid and is preferably large enough to encompass switch 10.

To adjust the operating temperature of switch 10, the switch is submerged in a liquid held by a container 80 (schematically shown). The temperature of the liquid is controlled by any known means (not shown) to be at the selected lower operating temperature of the switch. The switch is placed inside coil 77 so that the magnetic field created will affect the magnet in the switch with the flux opposite to the direction used to saturate the magnet. Switch 10 is also connected by conductors 81 to a means 82 for sensing the condition of the reed switch 44 in switch 10 to indicate whether it is open or closed. Means 82 may be any device known in the art such as a light and power source or a continuity meter that will indicate when the switch opens.

Referring to FIG. 5, the method of adjusting the magnet to a selected level comprises charging capacitor 74 to a level selected by the adjustment of potentiometer 73 by closing switch 75. The setting of potentiometer 73 is selected to produce a charge level on capacitor 74 that will produce a current that will reduce the magnetization of the magnet in switch 10 by a selected small incremental level. After capacitor 74 is charged, switch 75 is opened and switch 76 is closed to discharge capacitor 74 through coil 77. The initial surge through the switch 76 is in a direction and of a magnitude that will reduce the magnetization level of the magnet in switch 10 by an incremental amount. During the period switch 76 is closed, after the initial discharge surge, a decaying oscillation will occur in the circuit that includes the coil 77 and the capacitor 74 and an oscillating bidirectional current will flow through coil 77. Thus on the initial half cycle of current through coil 77, the magnetization level of the magnet in switch 10 will be reduced a given amount which will be largely recovered by the next half cycle of opposite oscillating current and then by decreasing differences so that the magnetization level of the magnet after the current has fully decayed is slightly lower that it was at the start. If switch 10 did not open upon the initial surge, which would be indicated by sensing means 82, the steps are repeated using incrementally higher voltages to charge capacitor 74. The increased voltage is obtained by opening the switch 76, closing switch 75 and raising the setting of potentiometer 73 by a selected incremental amount so the capacitor 74 is charged to an incrementally increased potential. The capacitor 74 is then again discharged through the coil 77 by the closing of switch 76. This process is continued in incremental steps until switch 10 opens and at this point the switch is calibrated for its selected temperature of operation and may be finely adjusted using slug 45.

While certain preferred embodiments of the invention have been specifically disclosed, it is understood that the invention is not limited thereto, as many variations will be readily apparent to those skilled in the art and the invention is to be given its broadest possible interpretation within the terms of the following claims.

What is claimed is:

1. A temperature responsive electric switch comprising: a magnet producing a magnetic field; a magnetically responsive switch element positioned in the magnetic field and movable to an open and closed position in response to the level of magnetic flux through said switch element; a compensating element formed of ferromagnetic material and having a magnetic permeability varying as a function of its temperature positioned in the magnetic field to shunt magnetic flux around the switch element at a level varying as a function of its temperature; and an adjusting element adjacent the switch element and movable to positions in the magnetic field to thereby bypass a selected portion of the magnetic flux around the switch element.

2. A temperature responsive electric switch according to claim 1 wherein said switch element is a reed switch movable to a closed position when the magnetic flux through it is greater than a first preselected level and to an open position when the magnetic flux is less than a second preselected level.

3. A temperature responsive electric switch according to claim 2 wherein said compensating element has a magnetic permeability that varies linearly as a function of temperature over a selected temperature range.

4. A temperature responsive electric switch according to claim 3 wherein said adjusting element is a shaft having a screw thread outer surface mounted in a sleeve and adjustable by rotation of the shaft to move along the sleeve.

5. A temperature responsive electric switch according to claim 4 wherein said magnet is cylindrical and mounted t enclose the switch element.

6. A temperature responsive electric switch according to claim 5 wherein said compensating element is adjacent and surrounding the magnet.

7. A temperature responsive electric switch according to claim 6 also comprising pole pieces one at each end of the magnet and wherein said compensating element extends between and abuts said pole pieces.

8. A temperature responsive electric switch according to claim 1 wherein said compensating element has a magnetic permeability that varies linearly as a function of temperature over a selected temperature range.

9. A temperature responsive electric switch according to claim 1 wherein said adjusting element is a shaft having a screw thread outer surface mounted in a sleeve and adjustable by rotation of the shaft to move along the sleeve.

10. A temperature responsive electric switch according to claim 1 wherein said magnet is cylindrical and mounted to enclose the switch element.

11. A method of adjusting the level of magnetization of a magnet in a switch of the type having a ferromagnetic element responsive to temperature to shunt part of the magnetic field around a magnetically responsive switch element, said method comprising: placing the assembled switch with the magnet within a unidirectional magnetic field of sufficient strength to saturate the magnet with a selected polarity and thereby move the switch to one of its open or closed positions; connecting a device to the switch to indicate the position of the switch; placing the switch in a liquid having a temperature selected to be the temperature at which the switch is to move to the other of its open or closed positions; placing a coil of a type capable of producing a magnetic field adjacent the switch in the liquid; charging a capacitor to a preselected level; discharging the capacitor through the coil in a direction that produces with the initial direction of current a magnetic field on the switch of a polarity opposite to the selected polarity and permitting the current through the capacitor and coil to oscillate and decay whereby half cycles of diminishing current levels of reversing polarity pass through the coil to produce corresponding magnetic fields; and repeating the steps of charging and discharging the capacitor through the coil but charging the capacitor at selected increments of increased charge level until during one of the discharging steps the device indicates that the switch has moved to the other of its open or closed positions.

* * * * *